US006023926A

United States Patent [19]

Flynn

[11] Patent Number: 6,023,926

[45] Date of Patent: Feb. 15, 2000

[54] CARPET STYLING YARN AND PROCESS FOR MAKING

[75] Inventor: William John Flynn, Sydenham, Canada

[73] Assignee: E. I. du Pont de Nemours and Company, Wilmington, Del.

[21] Appl. No.: 09/143,424

[22] Filed: Aug. 28, 1998

Related U.S. Application Data

[63] Continuation-in-part of application No. 08/925,882, Sep. 8, 1997, abandoned.

[51] Int. Cl.[7] ..... D02G 3/38; D02G 3/02

[52] U.S. Cl. ..... 57/210; 57/12; 57/16; 57/224; 57/252; 57/283

[58] Field of Search ..... 57/210, 247, 258, 57/16, 18, 207, 224, 228, 252, 3, 7, 12, 283, 284, 226, 227, 6

[56] References Cited

U.S. PATENT DOCUMENTS

| | | | |
|---|---|---|---|
| 3,775,955 | 12/1973 | Shah | 57/34 AT |
| 3,831,369 | 8/1974 | Northup et al. | 57/144 |
| 3,978,648 | 9/1976 | Yamagata et al. | 57/144 |
| 4,018,042 | 4/1977 | Maag et al. | 57/144 |
| 4,028,874 | 6/1977 | Maag et al. | 57/144 |
| 4,228,640 | 10/1980 | Talbot | 57/208 |
| 4,304,092 | 12/1981 | Bridges et al. | 57/207 |
| 4,355,592 | 10/1982 | Tajiri et al. | 57/247 |
| 4,542,619 | 9/1985 | Schwartz | 57/210 |
| 4,720,943 | 1/1988 | Arrant | 57/210 |
| 4,790,132 | 12/1988 | Nelson | 57/284 |

FOREIGN PATENT DOCUMENTS

| | | | |
|---|---|---|---|
| 0 232 714 A2 | 8/1987 | European Pat. Off. | D02G 3/38 |
| 31 26 051 A1 | 1/1983 | Germany | D02G 3/38 |
| 6123021 | 5/1994 | Japan . | |
| 08260277 | 10/1996 | Japan | D02G 3/22 |

OTHER PUBLICATIONS

Americal Suessen Corp., Technical Information Brochure "Parallel–Yarn" No. 7.1–10002 E (10.84), 8 pages.

Suessen Corp., Technical Information Brochure "ParafiL 2000 Parallel Spinning Machine" (Date unknown), 16 pages.

James Mackie & Sons, Ltd., Technical Information Brochure 61SB107 "Spinmack Wrap Spinner"(Date unknown), 6 pages.

*Primary Examiner*—John J. Calvert
*Assistant Examiner*—Tejash D Patel

[57] ABSTRACT

A carpet styling yarn comprises a core having at least two falsely twisted continuous yarns, and a single wrapper yarn spirally wrapped about the core. At least two of the core yarns are differently colored or differently colorable. The length of the single wrapper yarn is greater than the length of the core for any given unit length of the carpet styling yarn. A method for fabricating the carpet styling yarn, and to a carpet using the same, are also disclosed.

20 Claims, 2 Drawing Sheets

CARPET STYLING YARN AND PROCESS FOR MAKING

CROSS REFERENCE TO RELATED APPLICATION

This application is a continuation-in-part of application Ser. No. 08/925,882, filed Sep. 8, 1997 now abandoned.

BACKGROUND OF THE INVENTION

A popular feature of cut and loop pile carpets is the presence of randomly dispersed small regions or "islands" of color throughout. Currently, this is accomplished by using space-dyed yarns in the tufting operation. "Space-dyeing" refers to the process of dyeing white dyeable yarns in such a way that the color varies along the length of the yarn. The use of space-dyed yarns permits more colors to be placed into a tufted carpet. Thus, such yarns are considered to be valuable styling yarns by designers.

Another popular trend in the carpet industry is the use of solution-dyed yarns, also known as producer-colored yarns, in lieu of dyed or dyeable yarns. Solution-dyed yarns provide the advantages of not requiring dyeing, and generally having greater inherent resistance to stains, particularly acid type stains.

U.S. Pat. No. 4,542,619 (Schwartz) discloses a yarn, and a process and apparatus for making it, for use in carpets with a space-dyed look. The yarn contains a core of multicolor bulked continuous filament yarns wrapped with two wrapping yarns. One of the wrapping yarns extends in the clockwise direction and the other wrapping yarn extends in the counterclockwise direction. As a consequence, for a given length of the resulting yarn, the length of the core is greater than the length of the wrapping yarns, and the core has a sinusoidal profile.

U.S. Pat. No. 4,018,042 (Maag et al.) discloses a wrapped staple spun yarn and a process and apparatus for making it. The wrapped staple spun yarn is useful for various uses, including carpets. The wrapped staple spun yarn contains a single sliver spun from staple fibers surrounded by a helical wrapping yarn to hold the staple spun yarn together without the need for twisting. The process disclosed for making such a yarn includes feeding a sliver to a set of drafting rolls which further orient the sliver and reduce the sliver diameter. The drafting rolls forward the sliver to a rotating hollow spindle which holds the wrapping yarn thereon. As the sliver passes through the hollow spindle, the wrapping yarn is wrapped around the sliver with the assistance of a false twist device.

It is believed advantageous to provide a carpet styling yarn which, when used in loop pile tufted carpets, affords at least equivalent styling opportunity as space-dyed yarns. It is believed to be a further advantage to have a carpet yarn which combines the advantages of solution-dyed yarns with the aesthetics of space-dyed yarns in carpet.

SUMMARY OF THE INVENTION

The present invention relates to a carpet styling yarn, to a method for fabricating the same, and to a carpet using the same.

The carpet styling yarn of the present invention comprises a core having at least two falsely twisted continuous yarns, and a single wrapper yarn spirally wrapped about the core. The continuous yarns may take the form of either continuous bulked continuous filament (BCF) yarn(s) and/or continuous staple spun yarn(s).

The length of the single wrapper yarn is greater than the length of the core for any given unit length of the carpet styling yarn. Preferably, the single wrapper yarn has a linear density in the range of about 20 to about 50 denier and is wrapped about the core at a frequency of about one (1) to about five (5) wraps per inch.

At least two of the core yarns are differently colored or differently colorable. The different coloration of the core yarns may be achieved by using (i) differently colored, solution-dyed ("producer-colored") bulked continuous filament yarn, (ii) differently colored, dyed bulked continuous filament yarn, and/or (iii) differently colored, dyed staple spun yarn. The different coloration of the core yarns may also be achieved by using differently colorable bulked continuous filament yarn or staple spun yarn.

In the preferred case, each of the yarns in the core has a linear density in the range from about six hundred (600) to about thirteen hundred (1300) denier. The yarns in the core may either be nylon 6, nylon 6,6, polypropylene, poly (ethylene terephthalate) or poly(trimethylene terephthalate).

In accordance with the method of this invention, the styling yarn is formed by falsely twisting the yarns of the core by passing the core yarns through a rotating hollow spindle, and spirally wrapping around the core a single wrapper yarn so that the length of the single wrapper yarn is greater than the length of the core for any given unit length of the carpet styling yarn. Before they are falsely twisted, the core yarns are passed through a yarn guide and maintained at a tension of preferably between about twenty (20) and about one hundred (100) grams.

In another aspect, the present invention relates to a carpet comprising a plurality of above-described carpet styling yarns tufted into a backing.

BRIEF DESCRIPTION OF THE DRAWINGS

The invention will be more fully understood from the following detailed description, taken in connection with the accompanying drawings, in which.

DETAILED DESCRIPTION OF THE INVENTION

Figure 1:
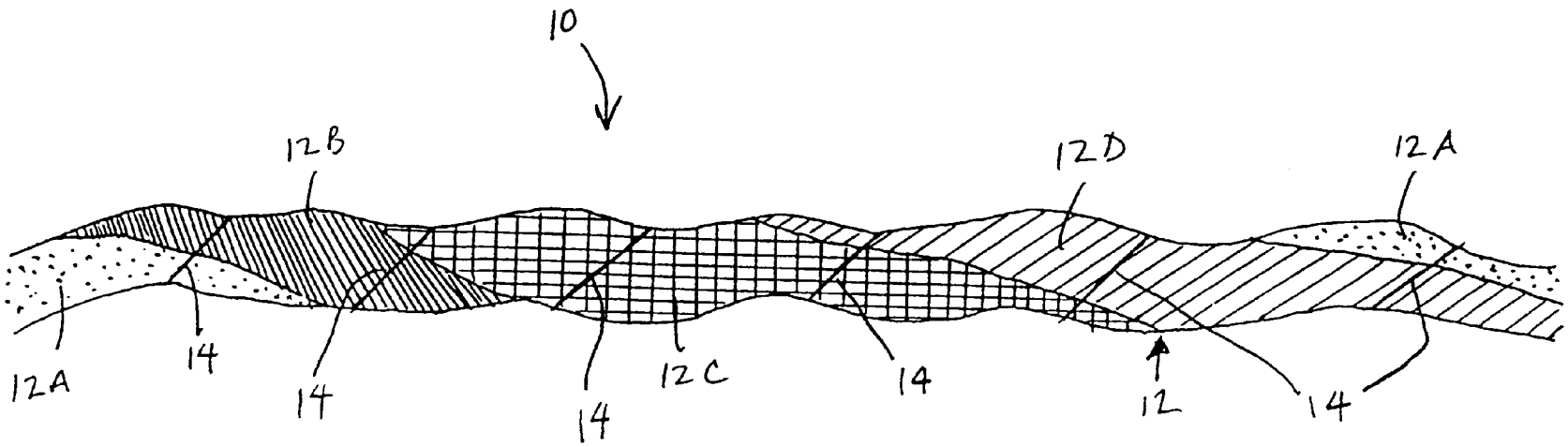
FIG. 1 is a side elevational view of a carpet styling yarn in accordance with the present invention.

Throughout the following detailed description similar reference numerals refer to similar elements in both figures of the drawings.

The carpet styling yarn 10 of the invention is illustrated in FIG. 1. The carpet styling yarn 10 comprises a core, generally indicated by reference character 12, having a plurality of N number of continuous yarns with a single wrapper yarn 14 spirally wound about the core. In accordance with the present invention the length of the wrapper yarn 14 is greater than the length of the core 12 for any given length of carpet styling yarn 10.

Preferably, the number N of yarns in the core 12 is between two and eight. Each core yarn may be bulked continuous filament (BCF) yarn or, alternatively, staple spun yarn, or a mixture thereof. Each core yarn preferably has a linear density in a range from about six hundred (600) to about thirteen hundred (1300) denier. The core yarns may be any fiber-forming polymer suitable for textile applications, including, but not limited to, nylon 6, nylon 6,6, polypropylene, poly(trimethylene terephthalate) and poly (ethylene terephthalate).

The yarns in the core are "continuous." By "continuous", as that term is used throughout this application, it is meant that there are no discontinuities, such as interruptions, breaks or gaps along the length of the yarn. "Continuous" yarn as used herein includes both bulked continuous filament (BCF) yarn and staple spun yarn. "Continuous" is meant to refer to the continuity along the length of the overall yarn, not to the continuity of the individual component filaments or fibers of the yarn. Thus, a break in one or more filaments or fibers forming a yarn would not constitute such a break as would render a yarn discontinuous for the purposes of this invention.

At least two of the yarns in the core are differently colored or differently colorable. The different coloration of the core yarns may be achieved by using (i) differently colored, solution-dyed (also known as "producer-colored") bulked continuous filament yarn, (ii) differently colored, dyed bulked continuous filament yarn, and/or (iii) differently colored, dyed staple spun yarn. The different coloration of the core yarns may also be achieved by using differently colorable bulked continuous filament yarn or staple spun yarn. By "differently colorable" it is meant that the yarn has a different dyeability, due, for example, to a yarn's different dye capacity, a yarn's different dye rate, or a yarn's response to different dye types.

The embodiment of the yarn 10 shown in FIG. 1 contains four core yarns, indicated by the reference characters 12A through 12D. Each of the core yarns in this illustrated embodiment is differently colored. The color difference for the core yarns 12A–12D is shown by the various hatching styles of each yarn.

There is no actual twist and substantially no intermingling between the yarns of the core 12, but rather a slight amount of false twist therebetween. This slight amount of false twist in the core 12 results in low frequency alternation of the predominant color of the yarn 10 along its length. Using a measurement of real twist to approximate the appearance of false twist, the level of false twist within the core 12 may be considered to be equivalent to real twist in the range of about zero (0) to about one (1) turns per inch.

The styling yarn 10 of the present invention is held together by the single wrapper yarn 14 which is spirally wound around the core 12. Preferably the wrapping frequency is between about one (1) and about five (5) wraps per inch, and more preferably, between about two-and-one-half (2.5) and about four (4) wraps per inch.

The wrapper yarn 14 may be any yarn having a linear density of about twenty (20) to about fifty (50) denier which is capable of wrapping around the core 12. The wrapper yarn 14 should not have a noticeable appearance when the yarn 10 is used in the manufacture of a carpet. The wrapper yarn 14 may be undyed, dyed or solution-dyed, and may be textured or untextured. Preferably, the wrapper yarn 14 is a forty (40) denier non-textured nylon yarn.

In its most preferred embodiment, the carpet styling yarn 10 of the present invention combines the advantages of solution-dyed yarns with the aesthetics of space-dyed yarns in carpet. To achieve this end, each of the N yarns forming the core 12 is a solution-dyed, sulfonated nylon 6,6 BCF yarn such as Antron® Lumena® fiber available from E. I. Du Pont de Nemours & Company, Incorporated, Wilmington, Del. For optimum styling capability it is preferred to select core yarns at least two of which are differently colored and have a high degree of contrast with each other in terms of color and clarity. Carpets made according to the present invention with such a combination of core yarns in a tufted loop pile construction contain several colors randomly dispersed with good color separation and "color pop."

In alternative embodiments the core 12 may contain BCF yarns or staple spun yarns which have previously been skein or stock dyed. In these cases, at least two of the N yarns has been dyed a different color, so that once again, the resulting carpet styling yarn 10 exhibits low frequency color changes along its length.

In still other alternative embodiments of the invention, each of the N yarns of the core 12 is an undyed nylon BCF yarn or undyed nylon staple spun yarn, with at least two of the yarns having different dyeabilities. In these cases, the carpet styling yarn 10 is initially a core 12 of white dyeable yarns wrapped by a single wrapper yarn 14. Such a carpet styling yarn 10 is dyed in subsequent processing, either in yarn or carpet form. After dyeing, the styling yarn 10 will exhibit low frequency color changes along its length, as described above. Previously heathered, undyed yarns containing yarns of different dyeabilities may also be used as the core yarns 12 in order to achieve particular stylistic effects in carpet.

It should also be understood that the yarns of the core 12 could be any combination of any yarn type (i. e., BCF yarn or staple spun yarn) colored by any of the above-discussed modes of yarn coloration.

As noted earlier, in all of the contemplated embodiments of the invention, the length of the wrapper yarn 14 is greater than the length of the core 12 per given length of carpet styling yarn 10. This difference in length is determined by unwrapping the wrapper yarn 14 and measuring its length and the length of the core 12.

In order to provide protection against static electricity, antistatic filaments may be included either in the core yarns of the core 12 and/or the wrapper yarn 14.

Carpet styling yarn 10 in accordance with the present invention can be used in conventional tufting processes to make a carpet. The carpet may be tufted employing a "step-over" tufting pattern or, alternatively, a straight stitch tufting pattern. The carpet may have a cut or loop pile construction.

The carpet using the yarn of the present invention exhibits space-dyed aesthetics. This carpet preferably has a randomly distributed multi-color pattern with good color separation and "color pop."

The attributes of the selected core yarns are imparted to the carpet. The carpet made with the above-described Antron® Lumena® fiber core yarn has an inherently high degree of stain resistance, color-fastness, bleach resistance and durability, in addition to having the capacity for many colors in a space-dyed appearance without the need for dyeing, of either the yarns or the carpet. A benefit of the present invention is that it may be used to make a multi-colored carpet having a space-dyed appearance without the need for dyeing and the associated expense and environmental concerns.

Figure 2:
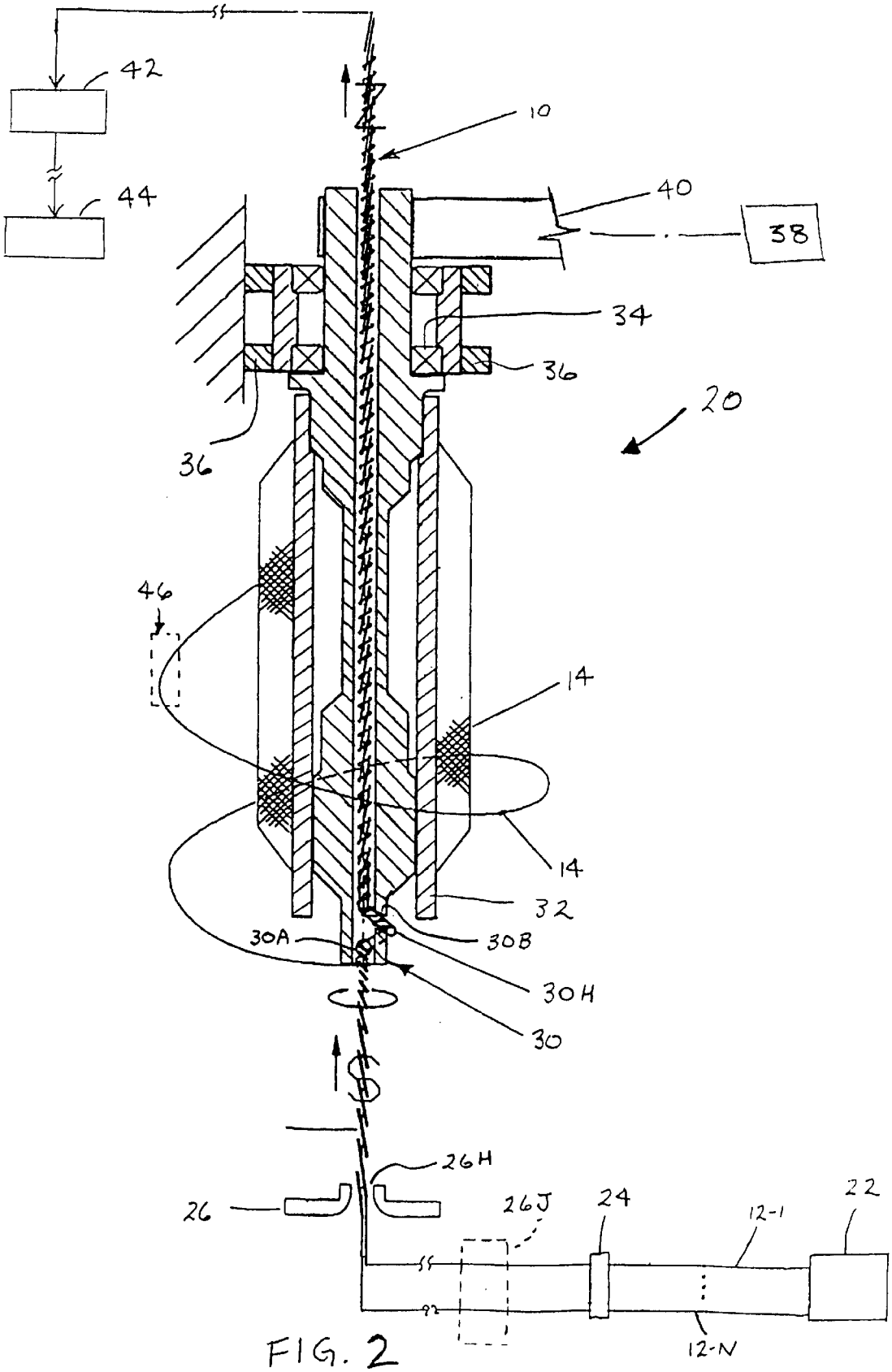
FIG. 2 is a side elevational view entirely in section of an apparatus for fabricating the carpet styling yarn of FIG. 1.

With reference to FIG. 2, an apparatus 20 for implementing the process for making the carpet styling yarn 10 of the invention will now be discussed. The N yarns 12-1 through 12-N forming the core 12 are fed from a creel 22, through a tensioner 24 and a yarn guide 26, to the input end of the wrapping apparatus 20.

The wrapping apparatus 20 includes a hollow spindle 30 capable of holding a single bobbin 32 of light denier wrapper yarn 14. The hollow spindle 30 is preferably a commercially available spindle such as those available from Spindelfabrik Suessen Schurr, Stahlecker & Grill GmbH, also known as Suessen, Germany. The spindle 30 is mounted on bearings 34 for rotational movement with respect to a fixed plate 36. One end of the spindle 30 is connected in driven relationship to a suitable motive source 38 by a drive belt 40. The other end of the spindle 30 has a pair of axially spaced, radially extending openings 30A, 30B therein. The exterior surface of the spindle 30, axially intermediate the openings 30A, 30B, preferably has a hook member 30H.

The creel 22 for use in the invention is a standard creel for use in textile operations which provides continuous supply of yarn to the wrapping apparatus 20. The creel 22 must be capable of supplying the desired number N of continuous yarns. Suitable tensioners 24 are those commercially available from Textrol, Inc., Monroe, N.C. The guide 26 is preferably located about two (2) to twenty (20) inches in advance of the spindle 30. The guide 26 preferably is in the form of a plate having a plurality of holes 26H therein.

The resulting styling yarn 10 is pulled linearly through and from the wrapping apparatus 20 by an accumulator 42. The accumulator 42 is commonly used in textile operations to interface between the pieces of equipment that carry out various operations, such as heat setting and winding. Such accumulators are commercially available from Belmont Textile Machinery Company, Belmont, N.C. Use of an accumulator is optional but is preferred in the present invention. In the absence of an accumulator 42, the yarns 12 may be pulled from the creel 22 through the wrapping apparatus 20 by other means, such as a winder or nip roll located after the wrapping apparatus 20.

The yarns are pulled from the accumulator 42 by a winder 44. The winder 44 is a standard piece of equipment commercially available for use in textile operations. The winder 44 pulls the finished carpet styling yarn 10 from the accumulator 42 and winds it onto an appropriately sized tube. A suitable winder 44 is available from Belmont Textile Machinery Company, Belmont, N.C.

In order to initialize the process the yarns 12-1 through 12-N are manually guided from the creel 22 through the tensioners 24 and the guides 26. In the preferred case the yarns 12-1 through 12-N are threaded through the bore of the spindle 30, radially outwardly through the lower radial opening 30A, and over the hook member 30H. The yarns 12-1 through 12-N are returned to the hollow bore of the spindle through the upper radial opening 30B. The core yarns emanating from the upper end of the bore of the spindle 30 are fed to a set of feed rolls (not shown), to the accumulator 42, and then to the winder 44. The single light denier wrapper yarn 14 from the bobbin 32 on the exterior of the spindle 30 is manually attached to the core yarns 12-1 through 12-N prior to the entrance to the spindle 30 by lightly wrapping one or two wraps around the core yarns.

To form the styling yarn 10 the hollow spindle 30 is rotated by the motive source 38 via the drive belt 40 at a predetermined speed, typically between about eight thousand (8,000) and about thirty thousand (30,000) rpm. As is well understood in the art of false twisting yarns, the bend of the yarn around the hook member 30H as the core yarns are moving through the spindle 30 results in false twisting of the core yarns at the entrance of the spindle 30. The cohesion of the core 12 is attributed to the amount of false twist thus imparted. Because of its tendency to untwist the false twist propagates along the length of the core yarns 12-1 through 12-N upstream of the spindle 30. Thus, false twist is present in the core yarns before they enter the spindle 30. The amount of false twist is determined by the combination of the linear yarn speed and the spindle rotational speed. Preferably, these speeds are selected to result in a false twist level approximated by about zero (0) to about one (1) turns per inch of real twist.

Simultaneously with the false twisting of the core yarns the single light denier wrapper yarn 14 is taken from the bobbin 32 and wrapped around the core 12. The frequency of the wraps is determined by the combination of the linear speed of the feed yarns and the spindle speed. The frequency of the wraps is preferably between about one (1) and about five (5) wraps per inch, and more preferably between about two-and-one-half (2.5) and about four (4) wraps per inch. The single wrapper yarn 14 captures a portion of the false twist present in the core yarns at the entrance of the spindle 30.

The tension of each core yarn 12-1 through 12-N as it is fed to the wrapping apparatus 20 is individually controlled by the tensioners 24. Preferably, the tension of each core yarn as measured between the creel 22 and the wrapping apparatus 20 is in the range of about twenty (20) to about one hundred (100) grams. It has been found that different stylistic effects may be achieved in the carpet by having a tension differential between core yarns 12-1 through 12-N making up a single carpet styling yarn 10. Generally, a single core yarn that is fed to the wrapping apparatus 20 under lower tension than the other core yarns will have a more prominent appearance in the final carpet.

The yarn guide 26 maintains separation of the core yarns 12-1 through 12-N as they are fed into the wrapping apparatus 20. The core yarns 12-1 through 12-N are fed through the holes 26H in such a way that produces a desired effect in the resulting carpet yarn 10. Each core yarn may be fed through its own unique hole 26H, or two yarns may be fed through the same hole 26H, for different effects in the resulting carpet.

Alternatively, if a different look in the carpet, such as a finer color distribution, is desired, a higher level of false twist should be imparted to the carpet styling yarn 10. This may be achieved by including an alternate twist ply jet 26J either between the tensioner 24 and the wrapping apparatus 20 or between the wrapping apparatus 20 and the feed rolls. In this instance the yarn guide 26 may be omitted. The alternate twist ply jet as disclosed in U.S. Pat. No. 5,179,827 (Tinsley et al.) may be used for the jet 26J.

In a preferred embodiment of the invention, an optical sensor 46 is provided in close proximity to the spindle 30 in order to detect the presence of the wrapper yarn 14 as it is fed from the bobbin 32. In the case of a break in the wrapper yarn 14 during the process of the invention, a signal from the optical sensor 46 will trigger an alarm and/or cause the process to shut down automatically.

Those skilled in the art, having the benefits of the teachings of the present invention as set forth herein, may effect numerous modifications thereto. Such modifications are to be construed as lying within the scope of the present invention, as defined by the appended claims.

What is claimed is:

1. A carpet styling yarn comprising:

a core having at least two yarns therein, all of the yarns in the core being continuous yarns that are falsely twisted together at a false twist level between zero and one turn per inch, at least two of the yarns in the core being differently colored or differently colorable; and a single wrapper yarn spirally wrapped about the core, the level of false twist resulting in a low frequency alteration of the predominant color of the styling yarn along its length.

2. The carpet styling yarn of claim 1 wherein the single wrapper yarn is spirally wrapped about the core at a frequency of about one (1) to about five (5) wraps per inch.

3. The carpet styling yarn of claim 1 wherein the single wrapper yarn has a linear density in the range of about twenty (20) to about fifty (50) denier.

4. The carpet styling yarn of claim 1 wherein at least one of the yarns in the core is a solution-dyed bulked continuous filament yarn.

5. The carpet styling yarn of claim 4 wherein each of the yarns in the core is a solution-dyed bulked continuous filament yarn having a linear density in the range of about six hundred (600) to about thirteen hundred (1300) denier.

6. The carpet styling yarn of claim 5 wherein the bulked continuous filament yarns are selected from the group consisting of nylon 6, nylon 6,6, polypropylene, poly(ethylene terephthalate) and poly(trimethylene terephthalate).

7. The carpet styling yarn of claim 1 wherein at least one of the yarns in the core is a staple spun yarn.

8. The carpet styling yarn of claim 1 wherein at least one of the yarns in the core is under a tension force that is different from the tension force imposed on at least one other yarn of the core.

9. A method of forming a carpet styling yarn comprising the steps of:

(a) forming a yarn core having at least two yarns therein by falsely twisting the yarns at a false twist level between zero and one turn per inch, all of the yarns in the core being continuous yarns, at least two of the yarns in the core being differently colored or differently colorable; and (b) spirally wrapped around the core a single wrapper yarn, the level of false twist resulting in a low frequency alteration of the predominant color of the styling yarn along its length.

10. The method of claim 9 wherein the single wrapper yarn is spirally wrapped about the core at a frequency of about one (1) to about five (5) wraps per inch.

11. The method of claim 9 wherein the single wrapper yarn has a linear density in the range of about twenty (20) to about fifty (50) denier.

12. The method of claim 9 wherein at least one of the yarns in the core is a solution-dyed bulked continuous filament yarn.

13. The method of claim 9 wherein at least one of the yarns in the core is a staple spun yarn.

14. The method of claim 9 wherein the step of falsely twisting the at least two continuous yarns is accomplished by passing the yarns through a rotating hollow spindle; and the single wrapper yarn is fed from a bobbin mounted about the rotating hollow spindle.

15. The method of claim 14 further comprising the steps of:

in advance of falsely twisting the at least two continuous yarns, passing the yarns through a yarn guide;

in advance of falsely twisting the at least two continuous yarns, maintaining the tension of the at least two continuous yarns at between about twenty (20) and about one hundred (100) grams.

16. The method of claim 9 further comprising imposing a tension force of a first magnitude on at least one of the yarns of the core and a tension force of a second, different, magnitude on at least one other yarn of the core.

17. The method of claim 9 further comprising the step of, prior to falsely twisting the continuous yarns forming the core, feeding at least two yarns of the core through a single opening in a yarn guide.

18. A carpet comprising a plurality of carpet styling yarns tufted into a backing, each carpet styling yarn comprising:

a core having at least two yarns therein, all of the yarns in the core being continuous yarns that are falsely twisted together at a false twist level between zero and one turn per inch, at least two of the yarns in the core being differently colored or differently colorable; and a single wrapper yarn spirally wrapped about the core, the level of false twist resulting in a low frequency alteration of the predominant color of the styling yarn along its length.

19. The carpet of claim 18 wherein at least one of the falsely twisted continuous yarns in the core is a solution-dyed bulked continuous filament yarn.

20. The carpet of claim 18 wherein at least one of the falsely twisted continuous yarns in the core is a staple spun yarn.

* * * * *